US005119086A

United States Patent [19]

Nishioka et al.

[11] Patent Number: 5,119,086

[45] Date of Patent: Jun. 2, 1992

[54] APPARATUS AND METHOD FOR GRAY SCALE DISPLAY

[75] Inventors: Kiyokazu Nishioka; Hiroyuki Mano; Nobuo Tsuchiya, all of Yokohama, Japan

[73] Assignees: Hitachi Ltd., Tokyo; Hitachi Video Engineering Inc., Kanagawa, both of Japan

[21] Appl. No.: 366,163

[22] Filed: Jun. 14, 1989

[30] Foreign Application Priority Data

Jun. 18, 1988 [JP] Japan ..... 63-150541

[51] Int. Cl.[5] ..... G09G 3/00

[52] U.S. Cl. ..... 340/793; 340/703

[58] Field of Search ..... 340/793, 703; 358/79, 358/455, 81, 80

[56] References Cited

U.S. PATENT DOCUMENTS 4,827,255 5/1989 Ishii ..... 340/793

FOREIGN PATENT DOCUMENTS 0192815 9/1986 European Pat. Off. .
0251811 1/1988 European Pat. Off. .
0281502 1/1988 European Pat. Off. .
8603614 6/1986 United Kingdom .

*Primary Examiner*—Alvin E. Oberley
*Assistant Examiner*—Xiao M. Wu
*Attorney, Agent, or Firm*—Antonelli, Terry, Stout & Kraus

[57] ABSTRACT

Disclosed is a system selecting one out of a plurality of gray scale signals for each color information in display information including color information of a plurality of colors for providing monochromatic gray scale signals at multiple levels corresponding to the display information, or, when multiple colors are produced by combining a plurality of colors, selecting one out of a plurality of gray scales for each color corresponding to gray scales of the multiple colors, to thereby attain a multi-level monochromatic emulation display.

5 Claims, 16 Drawing Sheets

FIG. 2B

| DISPLAY SIGNAL LINE | | | COLOR | GRAY SCALE SIGNAL | GRAY SCALE |
|---|---|---|---|---|---|
| R | G | B | | | |
| 0 | 0 | 0 | BLACK | $Y_0$ | DARK |
| 0 | 0 | 1 | BLUE | $Y_1$ | ↑ |
| 0 | 1 | 0 | GREEN | $Y_2$ | |
| 0 | 1 | 1 | SKY BLUE | $Y_3$ | |
| 1 | 0 | 0 | RED | $Y_4$ | |
| 1 | 0 | 1 | PURPLE | $Y_5$ | |
| 1 | 1 | 0 | YELLOW | $Y_6$ | ↓ |
| 1 | 1 | 1 | WHITE | $Y_7$ | BRIGHT |

| LATCH CIRCUIT 39 | | | GRAY SCALE FOR BLACK |
|---|---|---|---|
| D2 | D1 | D0 | |
| 0 | 0 | 0 | $Y_0$ |
| 0 | 0 | 1 | $Y_1$ |
| 0 | 1 | 0 | $Y_2$ |
| 0 | 1 | 1 | $Y_3$ |
| 1 | 0 | 0 | $Y_4$ |
| 1 | 0 | 1 | $Y_5$ |
| 1 | 1 | 0 | $Y_6$ |
| 1 | 1 | 1 | $Y_7$ |

| GRAY SCALE DISPLAY SIGNAL LINE | | GRAY SCALE DISPLAY | GRAY SCALE |
|---|---|---|---|
| PD1 | PD0 | | |
| 1 | 1 | $Y_0$ | DARK |
| 0 | 1 | $Y_1$ | ↑ |
| 1 | 0 | $Y_2$ | ↓ |
| 0 | 0 | $Y_3$ | BRIGHT |

| SCAN FRAME | | ODD FRAME | | EVEN FRAME | |
|---|---|---|---|---|---|
| PDP DATA | | PD1 | PD0 | PD1 | PD0 |
| CONTENT OF REGISTER | | D0 | D2 | D1 | D3 |
| GRAY SCALE | 0 DARK | 1 | 1 | 1 | 1 |
| | 1 | 1 | 1 | 0 | 1 |
| | 2 | 0 | 1 | 0 | 1 |
| | 3 | 0 | 1 | 1 | 0 |
| | 4 | 0 | 1 | 0 | 0 |
| | 5 | 1 | 0 | 1 | 0 |
| | 6 | 1 | 0 | 0 | 0 |
| GRAY SCALE | 7 BRIGHT | 0 | 0 | 0 | 0 |

APPARATUS AND METHOD FOR GRAY SCALE DISPLAY

BACKGROUND OF THE INVENTION

1. Field of the Invention

The present invention relates to gray scale displaying capable of a display according to a plurality of luminance data and more particularly relates to an apparatus and a method for a gray scale display capable of displaying color information in accordance with luminance data corresponding to the color information.

2. Description of the Prior Art

Recently, miniaturization of office automation equipment has been extensively developed, keeping pace with the advance of the large scale integrated circuit technology and portable personal computers and the like and steadily extending their market. The chief factor in development of portable equipment is improvements in the display apparatus. Flat display devices such as liquid crystal, plasma, and EL (electro-luminescent) displays superseding the conventional CRT (cathode ray tube) are becoming important. The technology for gray scale display for emulating color display information with a monochromatic display, in particular, is useful in the sense that existing software can be used. As disclosed, for example, in Japanese Laid-open Patent Publication No. 58-57192, the liquid crystal display (hereinafter to be briefly referred to as "LCD") is enabled to make a half-tone display by being controlled such that displaying of statuses and non-displaying of statuses therein are switched at intervals of a certain number of frame cycles. Below wil be described such a gray scale display with reference to FIG. 2.

FIG. 2A is a block diagram of a display circuit in a personal computer showing a prior art example. Referring to the figure, reference numeral 1 denotes a central processing unit (hereinafter to be briefly referred to as "MPU"), 2 denotes an address bus, 3 denotes a data bus, 4 denotes an LCD timing controller (hereinafter to be briefly referred to as "LCTC"), 5 denotes a frame line marker signal (hereinafter to be briefly referred to as "FLM signal"), 6 denotes a selector, 7 denotes a compound bus, and 8–10 denote display memories R, G, and B, respectively. Further, 11–13 denote parallel-to-serial converters (each block thereof in the drawing is briefly labeled "P→S"), 14–16 denote display signal lines R, G, and B, respectively, 17 denotes a gray scale signal generator, 18 denotes a gray scale controller, 19 denotes a video signal line, 20 denotes a display data decoder, and 21 denotes a liquid crystal display (hereinafter to be briefly referred to as "LCD"). Operation of the circuit of FIG. 2 will be described below.

When the MPU 1 accesses the display memories 8–10, the selector 6 selects the address bus 2. Thereby, the MPU 1 is enabled to update or read the contents of the display memories 8–10. When the contents of the display memories 8–10 are to be displayed on the LCD 21, the selector 6 selects display address information which is output from the LCTC 4. Accordingly, the contents of the display memories 8–10 are read out in the sequence of scanning according to the information on the compound bus 7 and these are delivered to their respective parallel-to-serial converters 11–13. The information is thereby converted into R, G, and B display signals on lines 14–16, respectively, and are supplied to the gray scale controller 18 as display information. Meanwhile, the gray scale signal generator 17 delivers eight kinds of gray scale signals (Y0–Y7) to the gray scale controller 18. Of these gray scale signals, Y0, for example, provides the darkest display and Y7 provides the brightest display. The gray scale controller 18 selects a gray scale signal corresponding to the display information for eight colors conveyed by the display signals 14–16 and outputs it to the video signal line 19. Thereby, the circuit is enabled to emulate the eight-color display with a monochromatic display in eight gray scales. The correspondence between colors and gray scales are shown in FIG. 2B. The video signal on line 19, including such gray scale display information, is converted by the display decoder 20 into information that can be displayed on the LCD 21. The LCD 21 makes a display according to the delivered information, with frame synchronization taken from the FLM signal 5. What has just been described is the outline of the operation of the display circuit enabling the LCD to make a display of eight gray scales.

Below will be described detailed operations of the gray scale signal generator 17 and the gray scale controller 18 with which the present invention is most concerned.

FIG. 3 is a timing chart of the gray scale signals Y0–Y7 generated by the gray scale signal generator 17. The reference signal is the FLM signal on line 5 at one frame cycle (approximately 70 Hz). Seven frame cycles are used as a gray scale period. For example, the display for the signal Y1 is turned ON at the rate of 1/7. That is, the display is turned ON during one scan out of seven scans of the picture and it is turned OFF during the period of the remaining six scans. Thereby, the duty ratio of picture displaying is changed and a half tone display can be achieved. The signals Y2–Y6 are the signals that also change the duty ratio so that half tone display may be achieved similarly.

Details of the operation of the gray scale controller 18 will be described below with reference to FIG. 4.

FIG. 4 is a block diagram showing the gray scale controller 18. In the figure, circuit blocks and signal lines corresponding to those in FIG. 2 are denoted by corresponding reference numerals. Referring to FIG. 4, reference numeral 22 denotes a decoder of a three-bit structure, 23–30 denote AND circuits, and 31 denotes an OR circuit. The decoder 22 decodes the color information conveyed by the R, G, B display signal lines 14–16 and turns ON only the AND circuit corresponding to that color. For example, if the color information is that for the black color, the AND circuit 23 is turned ON, or if it is for the blue color, the AND circuit 24 is turned ON. Therefore, the OR circuit 31 outputs the gray scale signal corresponding to the color information to the video signal line 19. The description made so far is of the operation of the gray scale controller 18 converting color information into gray scale information.

As described above, a gray scale display to achieve color emulation can be performed by a monochromatic display apparatus if the color display circuit is additionally provided with the gray scale signal generator 17 and gray scale controller 18. Thus, implementation of portable office automation equipment can be advanced taking over the great assets of application software intended for color display.

In the above described prior art, the correspondence between the color information and the luminance information was fixed. Therefore, there was a problem, when gray scale displaying was conducted using some existing application software intended to produce color information in which characters in "blue" color were frequently used with the background in "black" color, the difference in the luminance between the color of the characters and the color of the background became so small that the characters were difficult to detect. Further, the relationship between the duty ratio dependent on the gray scale cycle and the luminance differs with the characteristics of the LCD used. More particularly, the gray scale signals shown in FIG. 3 may be suitable for LCDs manufactured by a first manufacturer but gray scales, for example, of Y0–Y3 may be difficult to discriminate in LCDs manufactured by a second manufacturer because of uneven differences in luminance between the adjoining gray scales. Therefore, when using LCDs manufactured by the second manufacturer, it becomes necessary to change the timing of gray scale cycles for the gray scale signals (Y0–Y7) and also to change the circuit in the gray scale signal generator accordingly so that suitable luminance differences may be obtained, and this was a difficulty in effective product development.

SUMMARY OF THE INVENTION

An object of the present invention is to solve the above described problems and, accordingly, to provide an apparatus and a method for gray scale displaying in which multiple gray scales for luminance for any color information are provided, any one of which is selectable at will.

Another object of the present invention is to provide a monochromatic emulation system capable of converting the color information provided with such gray scales into corresponding monochromatic gray scale information.

A further object of the present invention is to provide an apparatus and a method for gray scale displaying adapted to be favorably compatible with application software intended for color displaying.

A still further object of the present invention is to provide an apparatus and a method for gray scale displaying suitable for use in display devices whose relationships between the duty ratio in displaying and luminance information are different from one another.

To achieve the above enumerated objects, the present invention, in a display system capable of producing multiple colors by combining a plurality of colors, stores display information including color information of the above described combined colors, generates gray scale signals for each of the above described plurality of colors as a plurality of gray scale signals, selects one out of the gray scale signals for each of the colors in accordance with the color information of each combined color in the display information, and displays, according to the display information, the gray scale for the color information of each combined color. Further, the present invention generates a plurality of gray scale signals for a predetermined color corresponding to a color represented by some color information and selects one out of the gray scale signals corresponding to the color information in the display information to thereby perform monochromatic emulation.

Another gray scale displaying apparatus according to the present invention stores information for turning the display means on and off during each frame cycle within one cycle, which has been formed of a plurality of frames, corresponding to each color represented by the color information, generates gray scales by updating or reading the stored contents for each frame, and, in response to the display information, selects and displays the output of the gray scales corresponding to the display information According to the present invention, it is possible for the user to optionally select any gray scale signal out of a plurality of gray scale signals that are previously prepared by a gray scale selector or a gray scale selectable generator thereof and apply the selected gray scale signal to each color.

Therefore, when the gray scale display apparatus is compatibly used for color application software, the user is enabled to connect the color to the gray scale in any desired relationship. When using display means of different characteristics, the gray scale signal suitable for the characteristics of each specific display means can be selected out of gray scale signals whose number is larger than the number of colors represented by the display information, whereby the variances in the characteristics can be coped with.

The foregoing and other objects, advantages, manner of operation and novel features of the present invention will be understood from the following detailed description when read in connection with the accompanying drawings.

BRIEF DESCRIPTION OF THE DRAWINGS

FIG. 2B is an explanatory drawing showing correspondence between colors and gray scale signals;

DETAILED DESCRIPTION OF THE PREFERRED EMBODIMENTS

An embodiment of the present invention will be described below with reference to FIG. 1.

Figure 1:
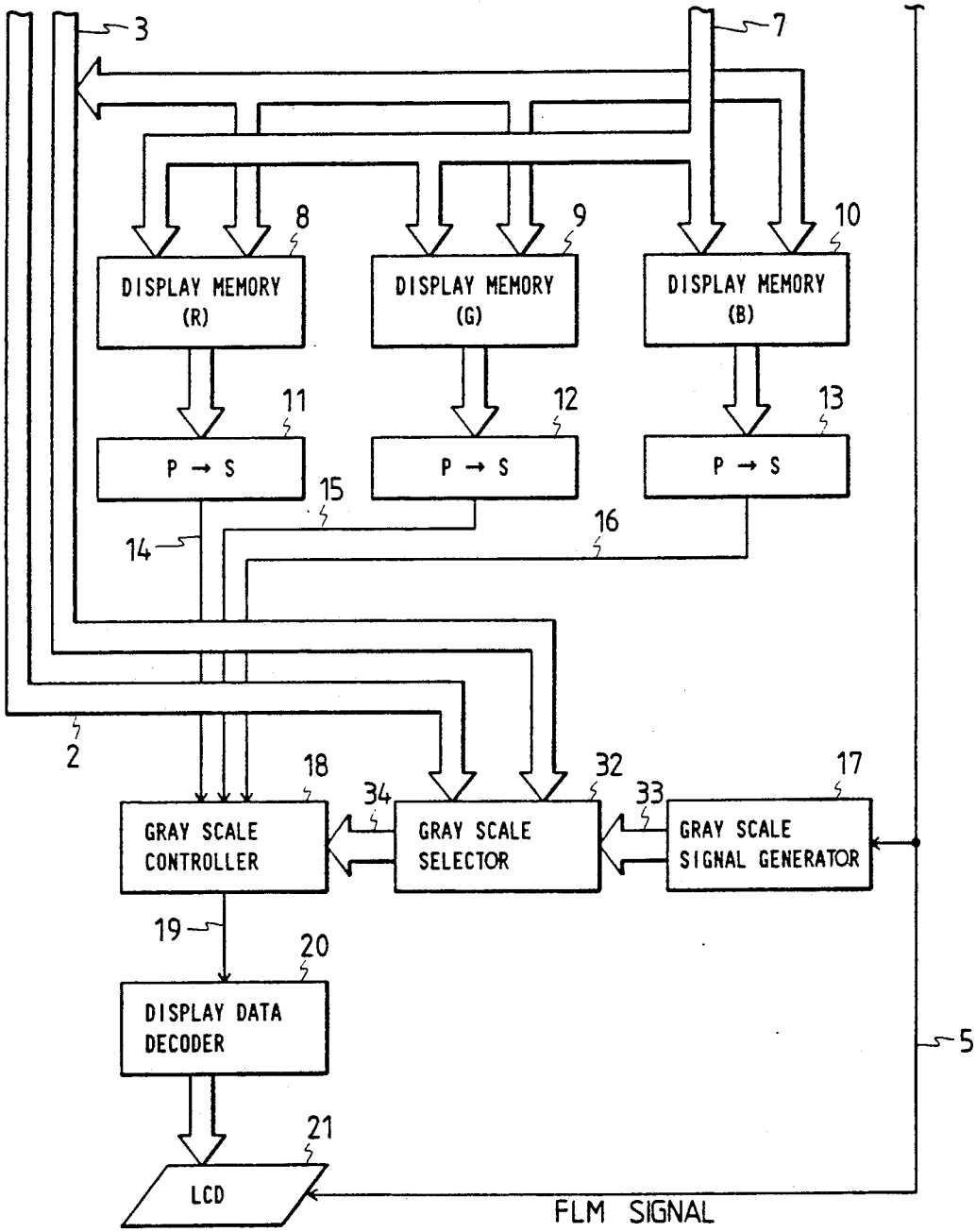
FIG. 1 is a block diagram of a display circuit showing an embodiment of the present invention.
Figure 2A:
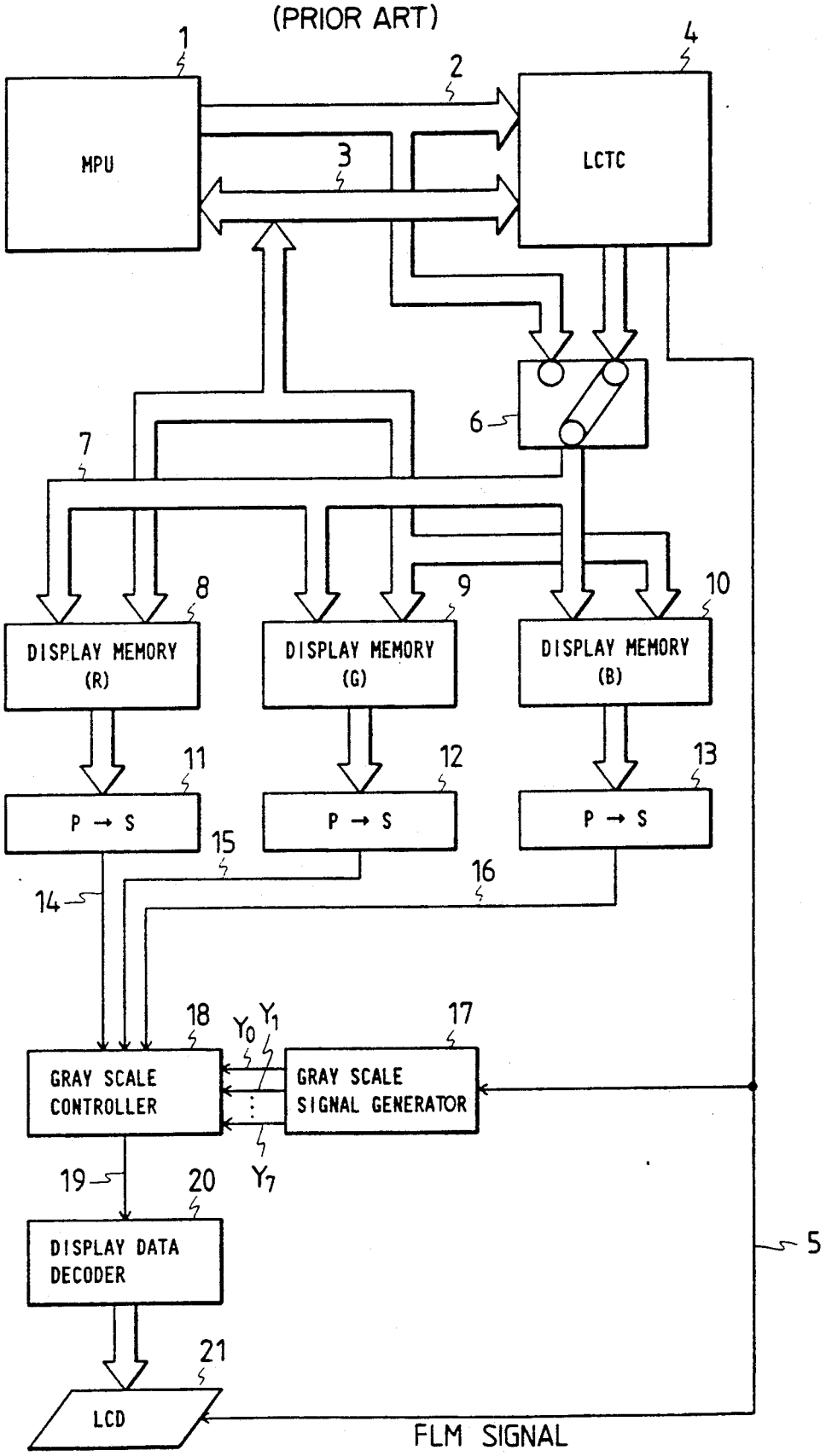
FIG. 2A (PRIOR ART)
FIG. 2A is a block diagram showing a prior art example.

FIG. 1 is a block diagram showing a personal computer display circuit to which the present invention is applied. In this figure, circuit blocks and signals corresponding to those in FIG. 2 are denoted by corresponding reference numerals. Referring to FIG. 1, reference numeral 32 denotes a gray scale selector, 33 denotes a gray scale signal line, and 34 denotes a selected gray scale signal line. The gray scale selector 32 receives gray scale select information through an address bus 2 and a data bus 3, and the selector selects information on the gray scale signal line 33 and delivers the selected signal to a gray scale controller 18 through the selected gray scale signal line 34. The gray scale controller 18 receives color display information stored in display memories 8-10 through parallel-to-serial converters 11-13, and the controller selects the gray scale information on the selected gray scale signal line 34 corresponding to the above color display information and outputs the selected information to a gray scale display signal line 19. Further, a display information decoder 20 generates visible information and thereby a gray scale display is made on an LCD 21. Thus, by setting up information in the gray scale selector 32, the correspondence between the color for a color display and the luminance for a gray scale display can be controlled at will.

The gray scale selector 32 as the principal portion of the present invention will be described below in detail with reference to FIG. 5.

Figure 5:
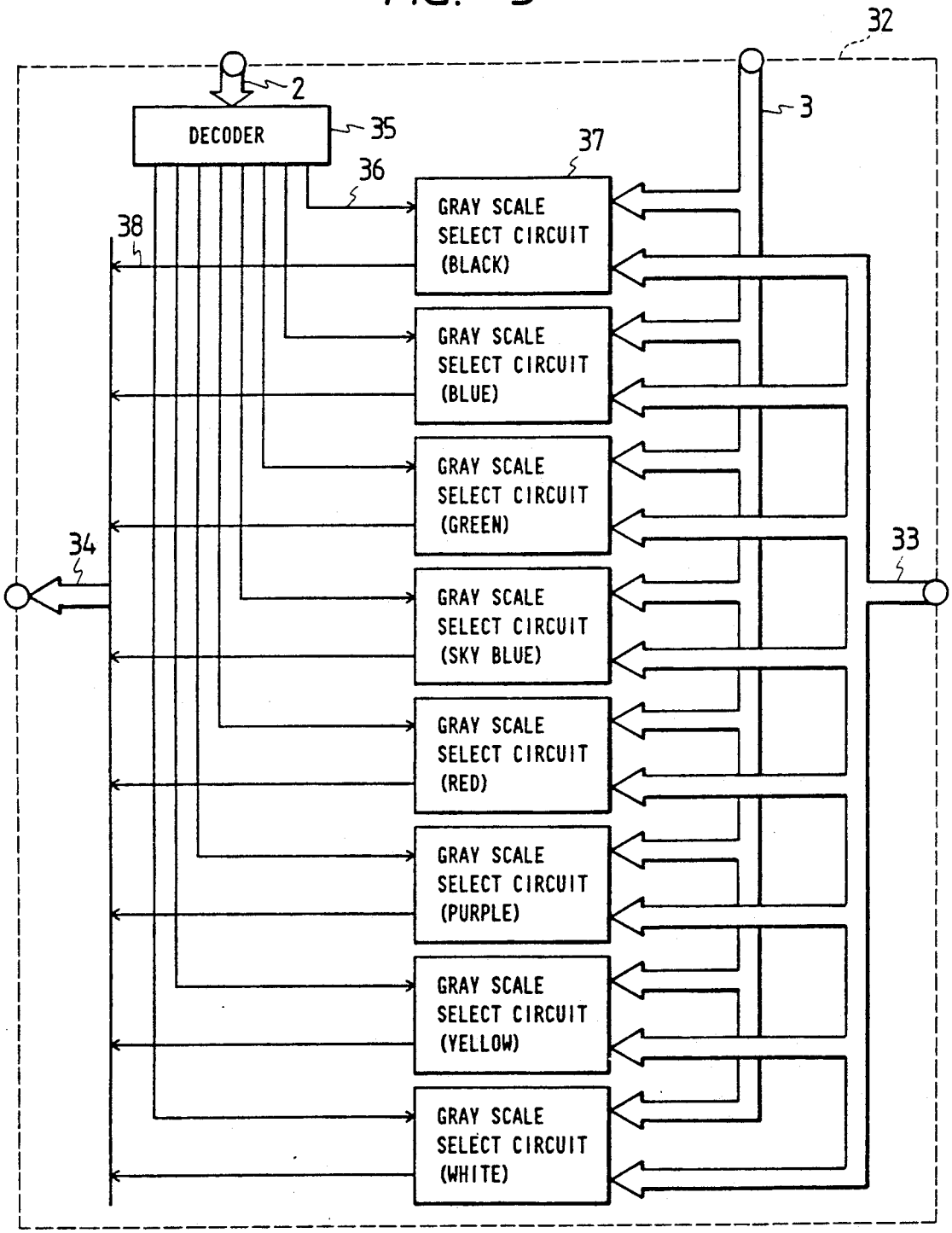
FIG. 5 is a detailed drawing of a gray scale selector in FIG. 1.

FIG. 5 is a block diagram showing details of the gray scale selector 32. In the figure, circuit blocks and signal lines having corresponding functions to those in FIG. 1 are denoted by corresponding reference numerals. Referring to FIG. 5, reference numeral 35 denotes a decoder, 36 denotes a decoded output signal, 37 denotes a gray scale select circuit, and 38 denotes a selected gray scale signal line. The decoder 35 decodes information on the address bus 2 and outputs the decoded signals to eight gray scale select circuits provided for the eight colors. Since, for example, the selected gray scale signal line 38 delivers the gray scale information corresponding to "black", the decoded output signal line 36 is assigned to the address for establishing the gray scale information corresponding to "black". Further, the gray scale select circuit 37 is adapted to select the information corresponding to "black" out of the information on the gray scale signal line 33 and to output it to the selected gray scale signal line 38. The circuit blocks in FIG. 5 drawn below the gray scale select circuit 37 in succession are gray scale select circuits for blue, green, sky blue, red, purple, yellow, and white.

The gray scale select circuit 37 will be described below with reference to FIG. 6A.

Figure 4:
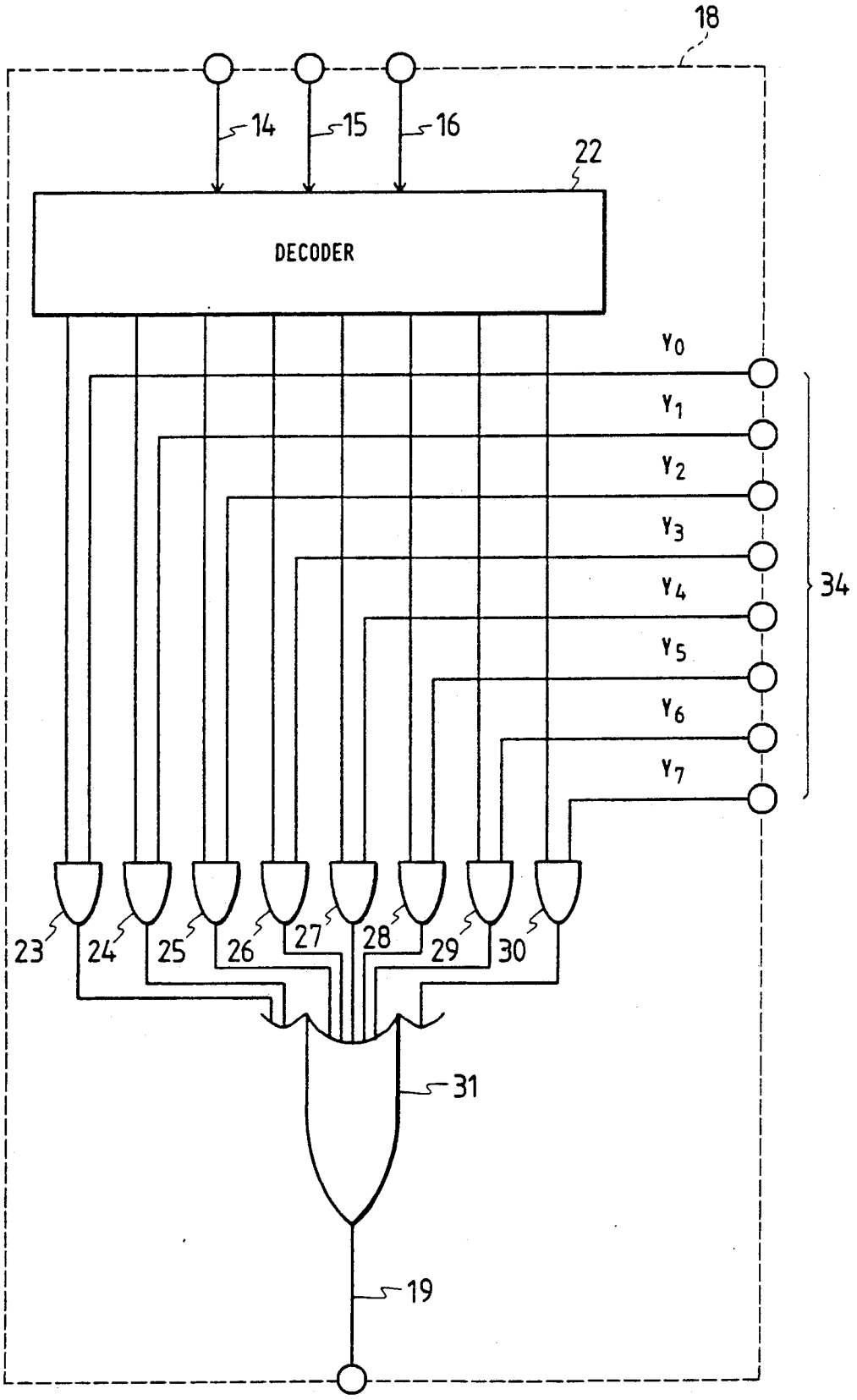
FIG. 4 is a detailed drawing of a gray scale controller for use in the system of FIG. 2A.
Figures 6A, 6B:
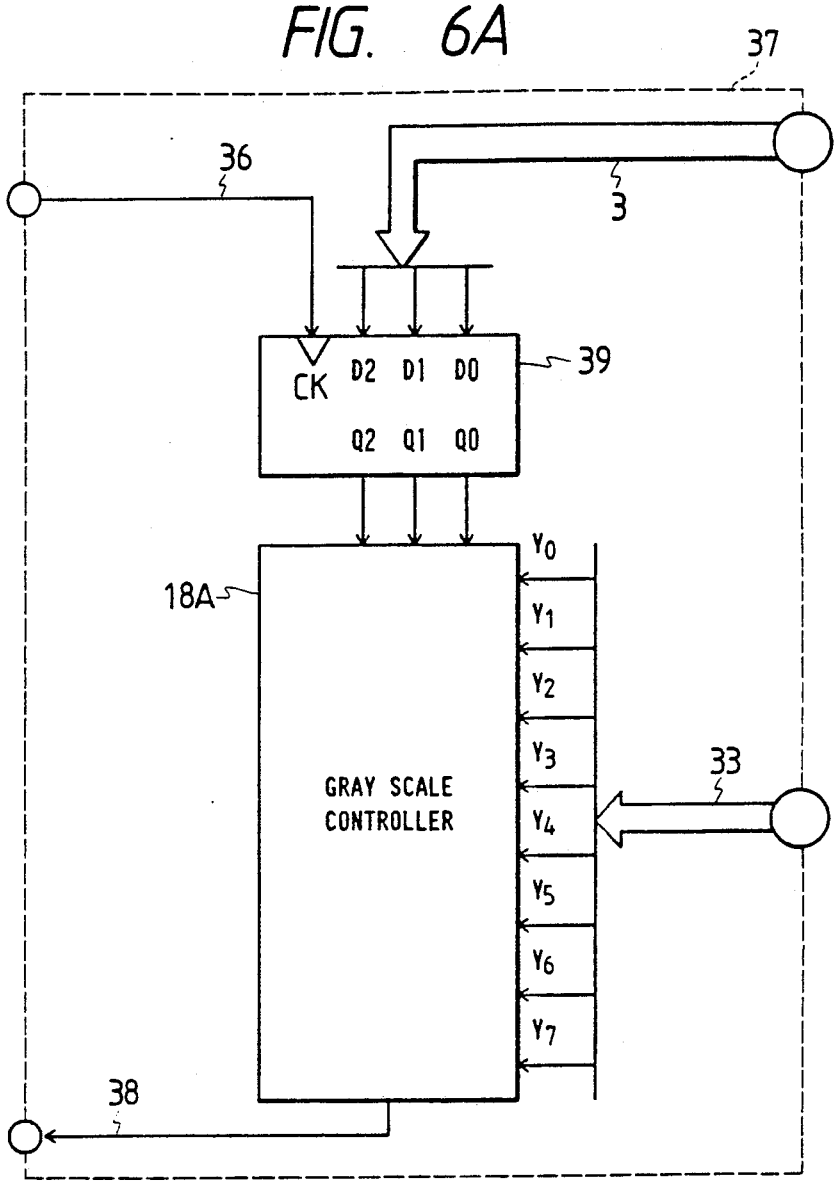
FIG. 6A is a detailed drawing of a gray scale select circuit in FIG. 5.
FIG. 6B is an explanatory drawing of gray scale select information.
Figure 6C:
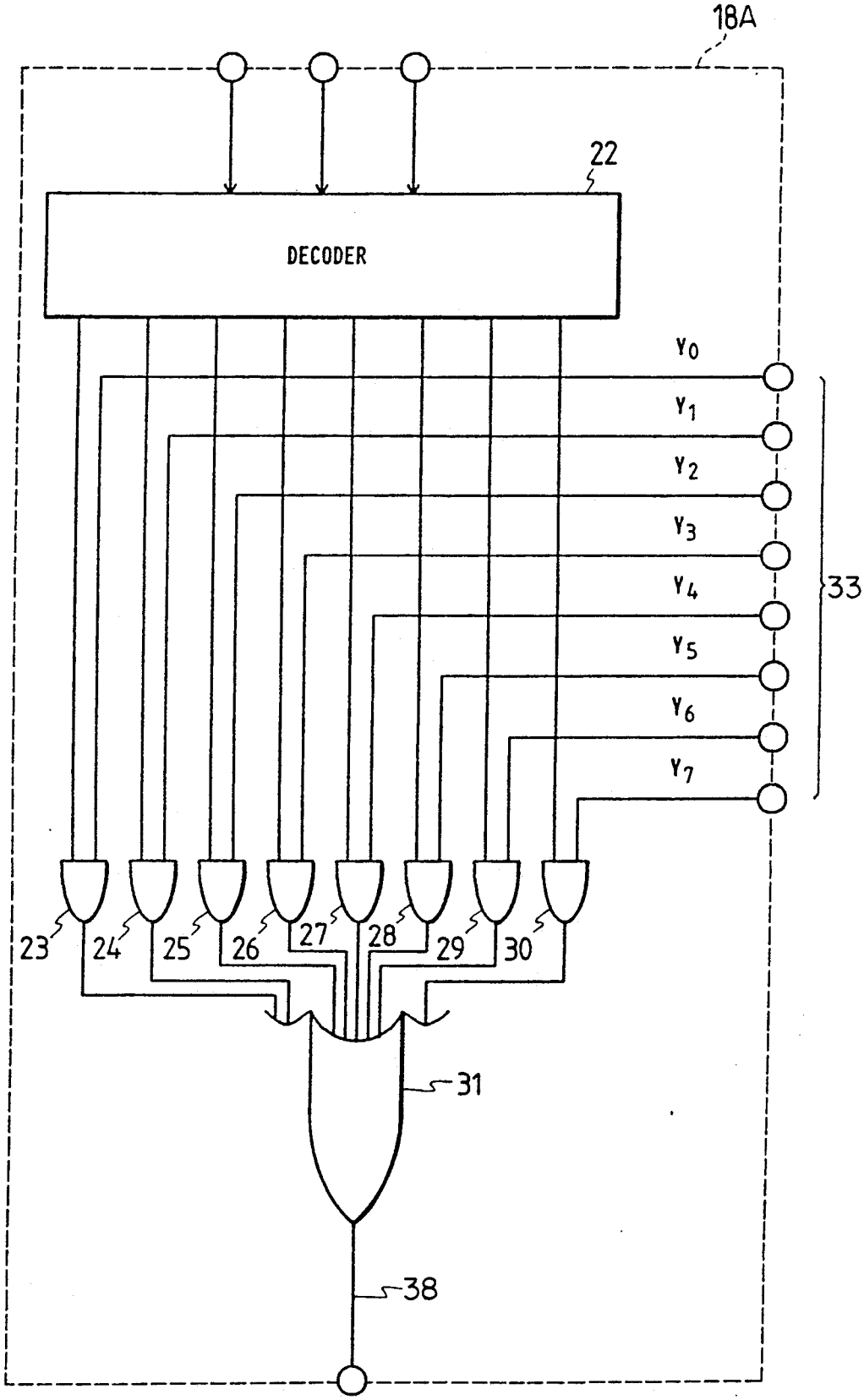
FIG. 6C is a detailed drawing of a gray scale controller for use in the gray scale select circuit of FIG. 6A.

FIG. 6A is a drawing showing details of the gray scale select circuit 37. In the figure, circuit blocks and signal lines having corresponding functions to those in FIG. 5 are denoted by corresponding reference numerals. Referring to FIG. 6A, 39 denotes a three-bit latch circuit which retains information of D2-D0 delivered from the data bus 3 at the timing given by the decoded signal line 36. This information is delivered to the gray scale controller 18A shown in FIG. 6C, the components of which are equivalent to those of gray scale controller 18 shown in FIG. 4. Thus one of the gray scale signals Y0-Y7 on the gray scale signal line 33 is selected and delivered to the selected gray scale signal line 38. The correspondence for the black color between the values in the latch circuit 39 and gray scales in the gray scale controller 18 within the gray scale select circuit 37 is shown in FIG. 6B. As is apparent from this figure, the gray scale allotted to the black color can be optionally selected from Y0-Y7 according to the value input to the latch 39. Similarly, a suitable gray scale to other color correspondence can be freely selected out of Y0-Y7.

Therefore, while the correspondence between colors and gray scales was fixed as shown in FIG. 2B when a color application software was executed in the prior art personal computer with a monochromatic display, a suitable correspondence between colors and gray scales according to the coloring employed in the application software can be selected in the present embodiment. More particularly, while the black color is always assigned the darkest gray scale Y0 according to FIG. 2B in the prior art, an optional one can be selected from Y0-Y7 in the present embodiment. Hence, whatever coloring is made, the most suitable color emulation can be achieved.

The present invention is not limited to the above described example. As one of other examples, the case where the invention is applied to a plasma display apparatus (hereinafter to be briefly referred to as "PDP") will be described below as a second embodiment.

Figure 3:
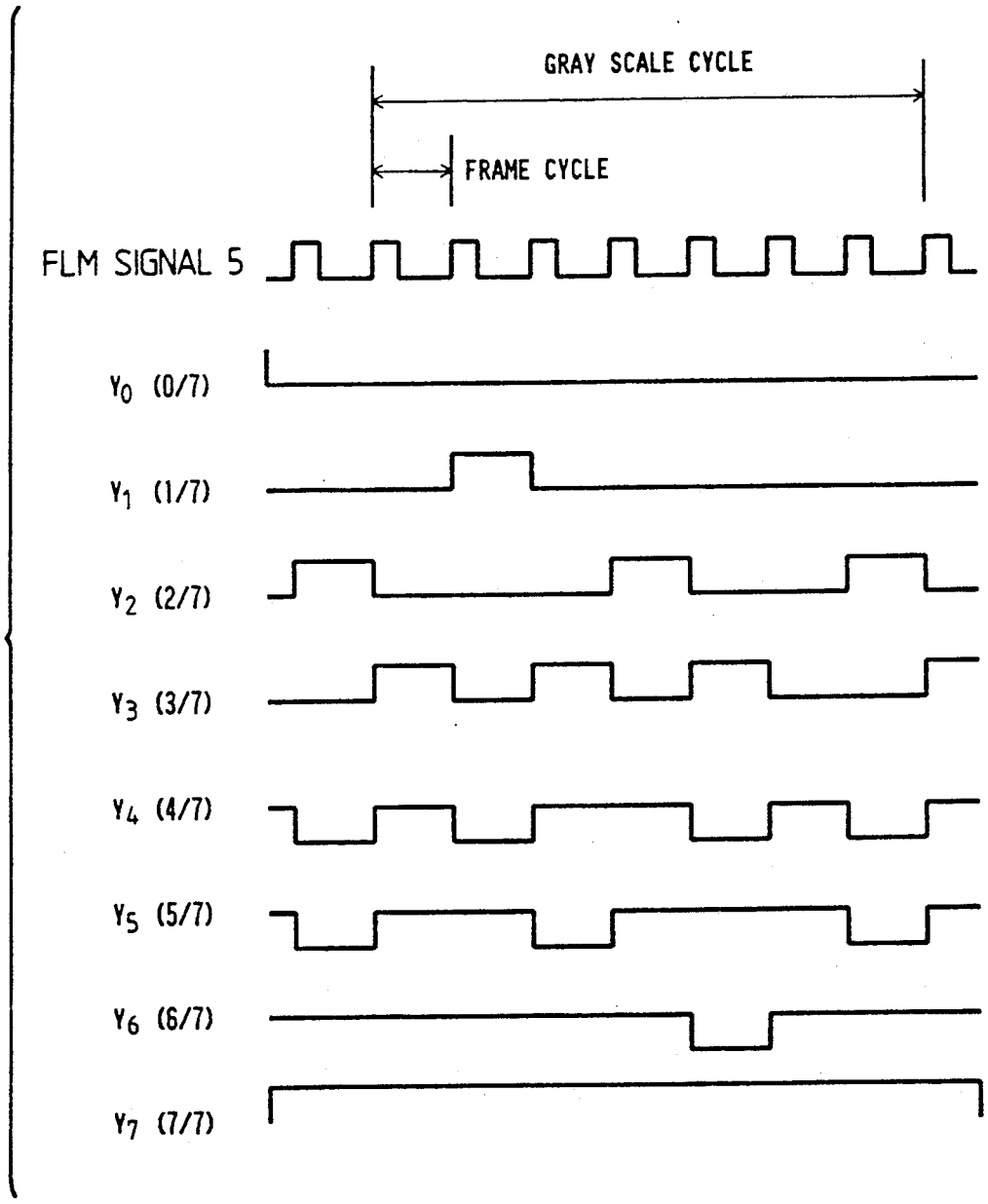
FIG. 3 is a timing chart for gray scale signals.

Since the PDP has a higher response speed than the LCD, when it is used at the timing of the gray scale signal Y1 shown in FIG. 3, its flickering becomes conspicuous and it is not practically usable. Therefore, to attain eight gray scales, a PDP capable of displaying four gray scales is used. Then, it becomes necessary to display half tone by switching two gray scales of different luminance at intervals of one picture scan. The case where the present invention is applied to the above described manner of operation will be described below with reference to FIG. 7A showing such an arrangement.

Figure 7A:
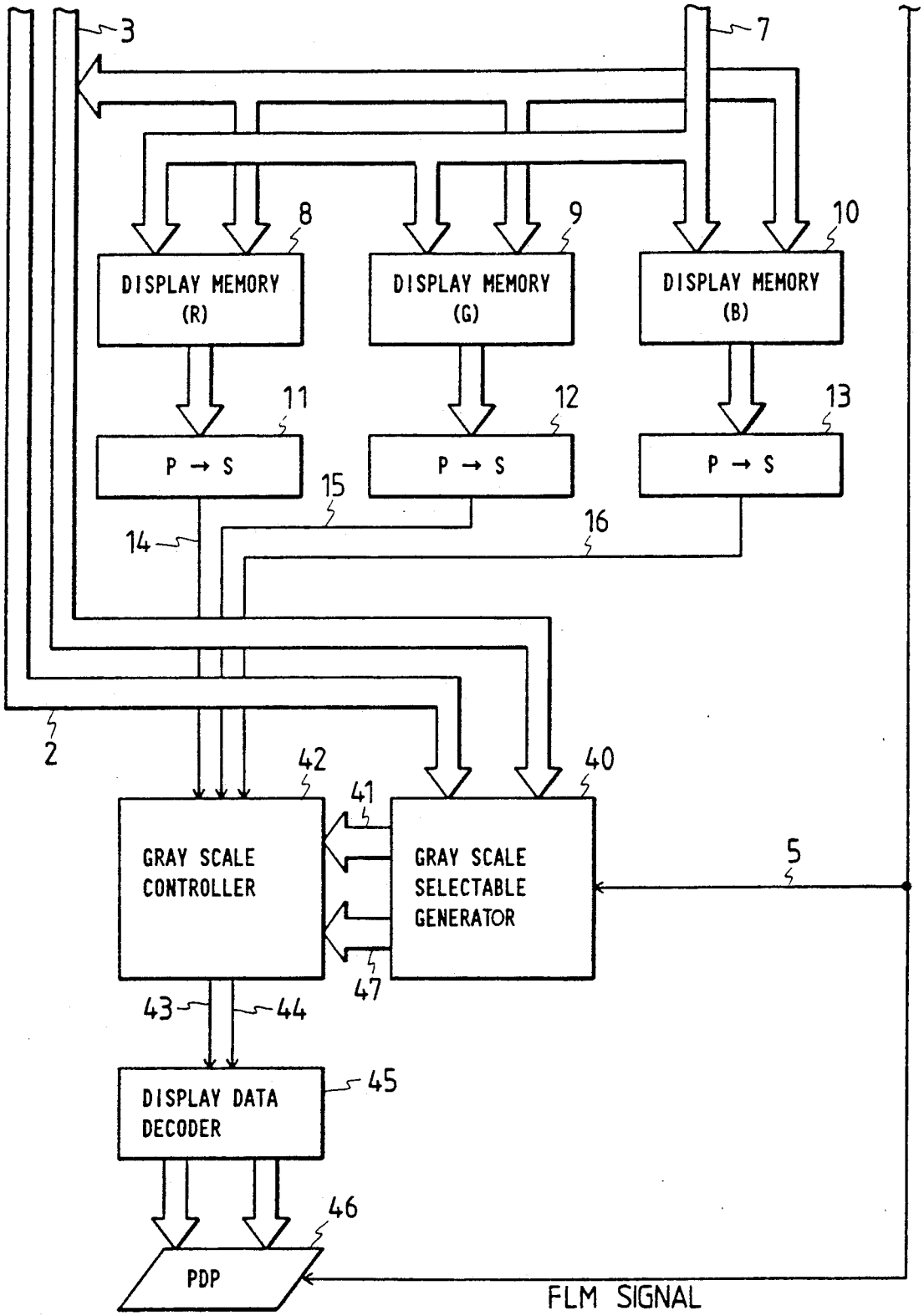
FIG. 7A is a block diagram showing a second embodiment of the present invention.
Figures 7B, 9A, 9B:
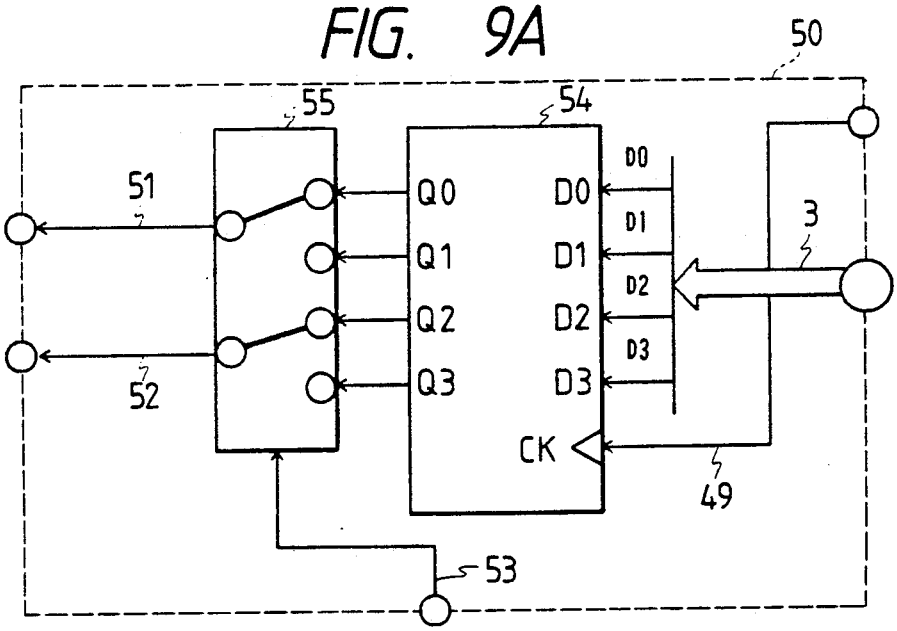
FIG. 7B is an explanatory drawing showing correspondence between display signals of a PDP and gray scale displays.
FIG. 9A is a detailed drawing of a gray scale select circuit in FIG. 8.
FIG. 9B is an explanatory drawing of gray scale select information.

FIG. 7A is a block diagram showing a display circuit using a PDP. In the figure, circuit blocks and signal lines having corresponding functions to those in FIG. 1 are denoted by corresponding reference numerals. Referring to the figure, reference numeral 40 denotes a gray scale selectable generator, 41 and 47 denote selected gray scale signal lines, 42 denotes a gray scale controller, 43 and 44 denote gray scale display signal lines (PD0 and PD1), 45 denotes a display data decoder, and 46 denotes a PDP capable of displaying four gray scales (for example, Matsushita-made MD400F640PD4). The gray scale controller 42 converts the information on the display signal lines 14-16 into gray scale information according to information on the selected gray scale signal lines 41 and 47 output from the gray scale selectable generator 40. The gray scale information is of a two-bit amount because it is for displaying four gray scales and it is transmitted through gray scale display signal lines 43 and 44. Representing the information on the gray scale signal line 43 by PD0 and that on the signal line 44 by PD1, relationships between these and gray scale displays are shown in FIG. 7B. The information is converted into visible information in the display data decoder 45 and displayed on the PDP 46.

Below will be described details of the gray scale selectable generator 40 as the principal portion of the present invention.

Figure 8:
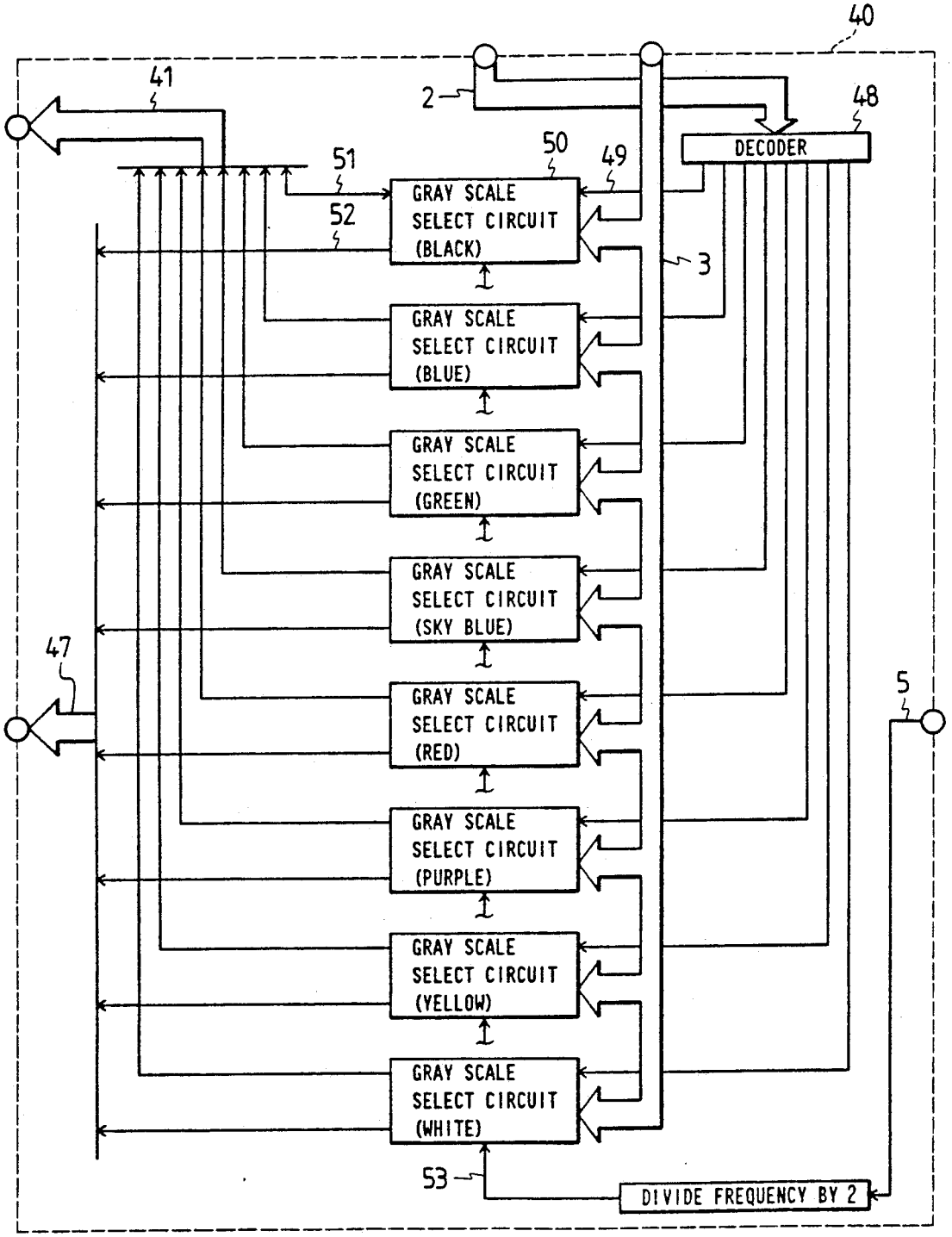
FIG. 8 is a detailed drawing of a gray scale selector in FIG. 7A.

FIG. 8 is a drawing showing details of the gray scale selectable generator 40. In the figure, circuit blocks and signal lines having corresponding functions to those in FIG. 7A are denoted by corresponding reference numerals. Referring to the figure, reference numeral 48 denotes a decoder, 49 denotes a decoded signal line for establishing the gray scale for "black", 50 denotes a gray scale select circuit 50 for "black", 51 and 52 denote selected gray scale signal lines for PD0 and PD1, respectively, 53 denotes a frame switching signal for discriminating and switching between an odd frame and an even frame. The decoder 48 decodes information on the address bus 2 and outputs the decoded signals to the eight gray scale select circuits. Since, for example, the selected gray scale signal lines 51 and 52 deliver the gray scale information corresponding to "black", the decoded output signal line 49 is assigned to the address for establishing the gray scale information corresponding to "black". The gray scale information for "black" is constituted of one portion of the gray scale information displayed on an even numbered frame and the other portion of the gray scale information displayed on an odd numbered frame. These portions are switched at intervals of one frame with the use of the frame switching signal 53 provided by dividing the frequency of the FLM signal on line 5 by two and are output to the selected gray scale signal lines 51 and 52. Referring to FIG. 8, the circuit blocks drawn below the gray scale select circuit 50 in succession are gray scale select circuits for blue, green, sky blue, red, purple, yellow, and white. The selected gray scale signal line 41 conveys PD0 information, while the signal line 47 conveys PD1 information, out of the gray scale information for eight colors.

The gray scale select circuit 50 will be described below with reference to FIG. 9A.

FIG. 9A is a drawing showing details of the gray scale select circuit 50, in which circuit blocks and signal lines having corresponding function to that those in FIG. 8 are denoted by corresponding reference numerals. Referring to FIG. 9A, reference numeral 54 denotes a four-bit latch circuit and 55 denotes a double-set selector. The latch circuit 54 retains informaton D3–D0 received from the data bus 3 at the timing given by the decoded signal line 49. The retained information is delivered to the selector 55. The selector 55, when the frame switching signal 53 indicates an odd frame, selects the information on Q0 and Q2 as shown in FIG. 9A and delivers it to the selected gray scale signal lines 51 and 52, respectively. When, conversely, the frame switching signal 53 indicates an even frame, information on Q1 and Q3 is selected. The correspondence between the gray scale information corresponding to "black" and the information set up in the latch circuit 54 is shown in FIG. 9B. In short, by setting up the information according to FIG. 9B, the gray scale information corresponding to "black" can be selected at will. Similarly, gray scale information corresponding to other colors than black can be produced by setting up information in each gray scale select circuit.

As understood from the description given above, the present invention can be easily embodied for gray scale displaying where such a display having a high response speed as a PDP is used. Therefore, the same effects as obtained in the first embodiment can be obtained from this embodiment.

Now, a third embodiment of the present invention will be described referring to FIG. 1 again. While the basic operation is the same as that in the first embodiment, operations in the gray scale signal generator 17 and the gray scale selector 32 are different. Therefore, these operations will be described below.

Figure 10:
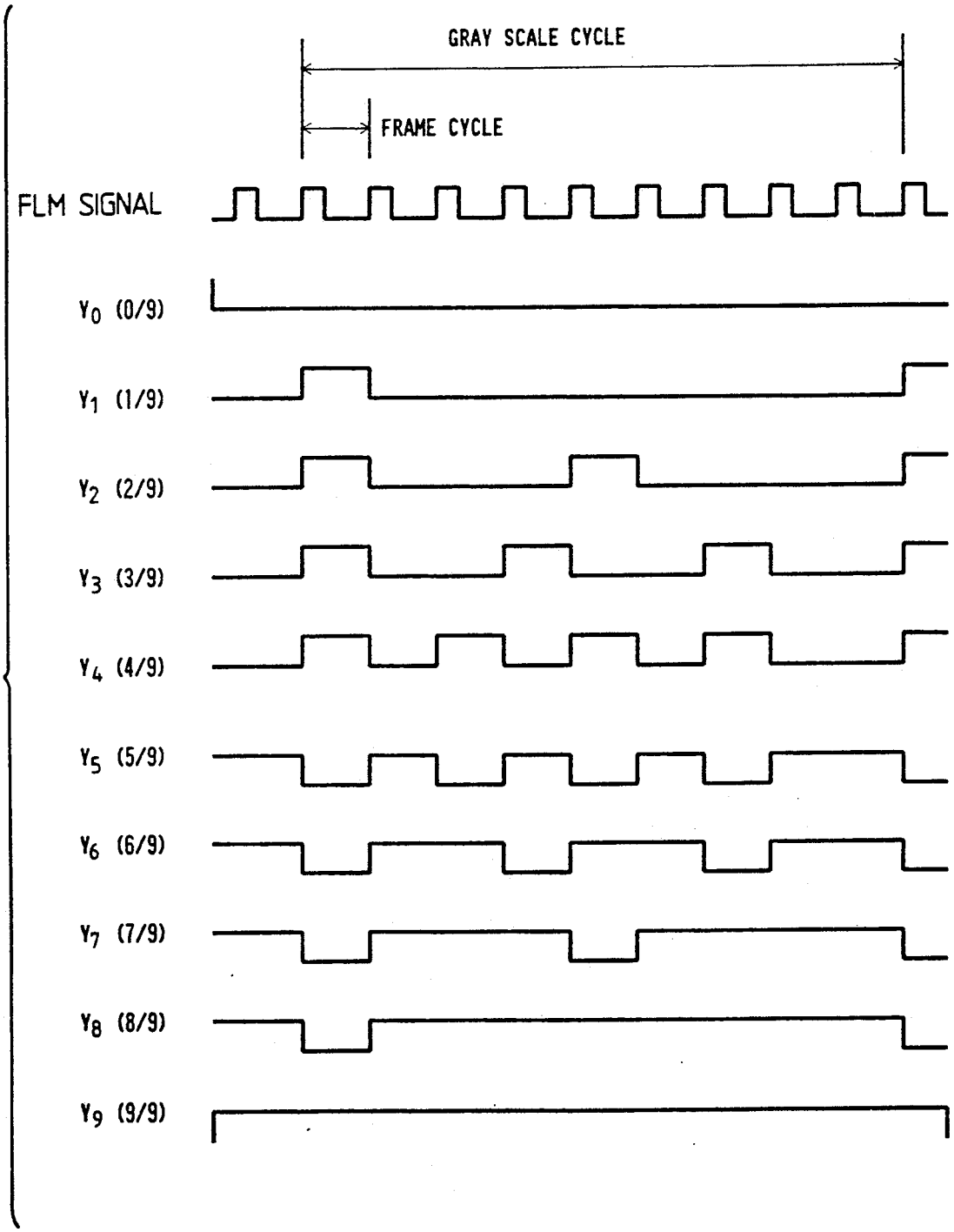
FIG. 10 is a timing chart of gray scale signals in a third embodiment of the present invention.

FIG. 10 is a timing chart of the gray scale signal line 33 output from the gray scale signal generator 17. The gray scale signal generator 17 uses a nine-clock period of the FLM signal as the gray scale cycle to thereby generate 10 gray scale signals. These gray scale signals can be easily obtained by a simple circuit combination including a mod-9 counter. Thus, the gray scale selector 32 selects eight gray scale signals suitable for the display on the LCD 21 out of the 10 gray scale signals.

Below will be described details of the gray scale selector 32.

The basic structure of the gray scale selector 32 is the same as that of FIG. 5, but, the structure of the gray scale select circuit 37 is different, and therefore, description of it will be given below referring to FIG. 11.

Figure 11:
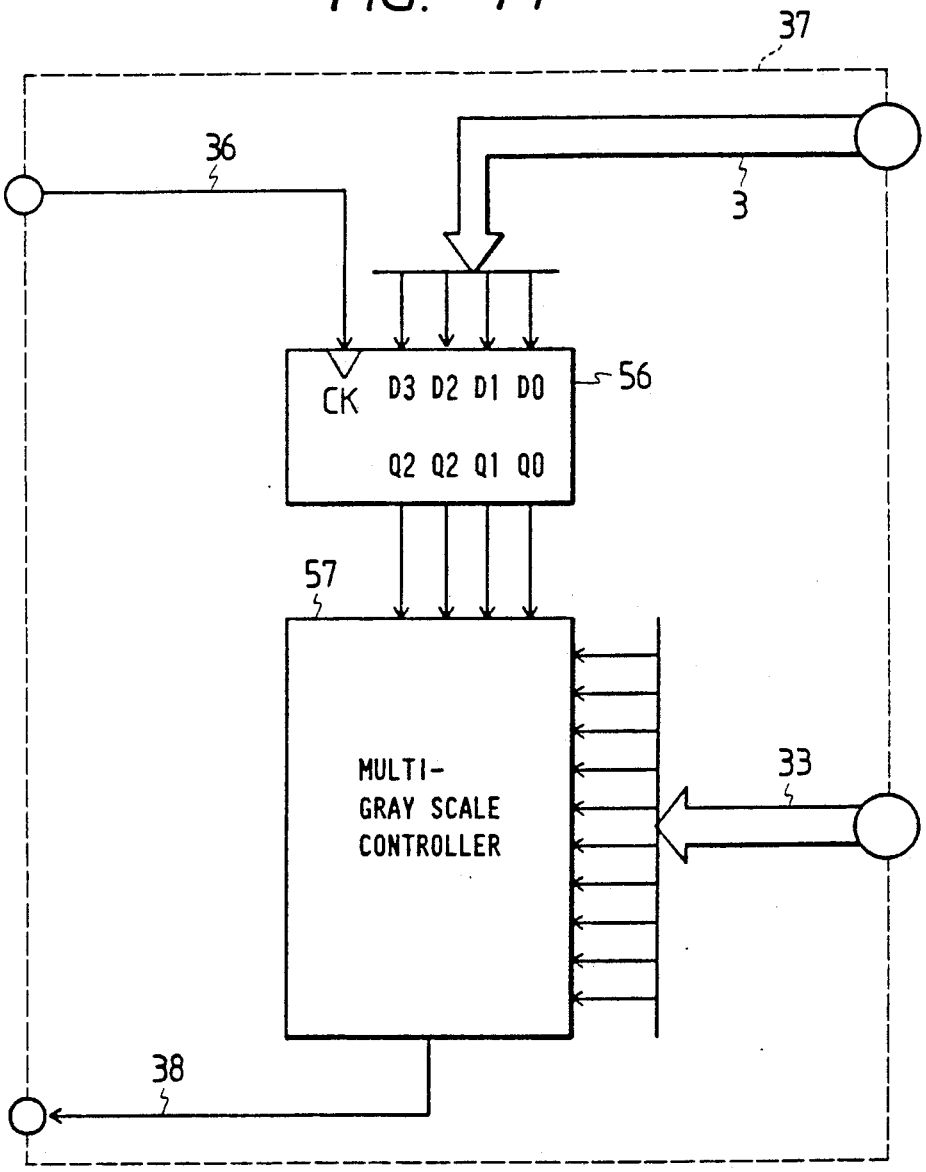
FIG. 11 is a detailed drawing of a gray scale select circuit.

FIG. 11 is a detailed drawing showing the gray scale select circuit 37 for selecting one out of the 10 gray scale signals. In the figure, circuit blocks and signal lines having corresponding functions to those in FIG. 5 are denoted by corresponding reference numerals. Referring to FIG. 11, reference numeral 56 denotes a four-bit latch circuit and 57 denotes a multiple gray scale controller. The latch circuit 56 retains gray scale select information formed of four bits and delivers it to the multiple gray scale controller 57. The multiple gray scale controller 57 selects one of the 10 gray scale signals and outputs it to the selected gray scale signal line 38.

Details of the multiple gray scale controller 57 will now be described.

Figure 12:
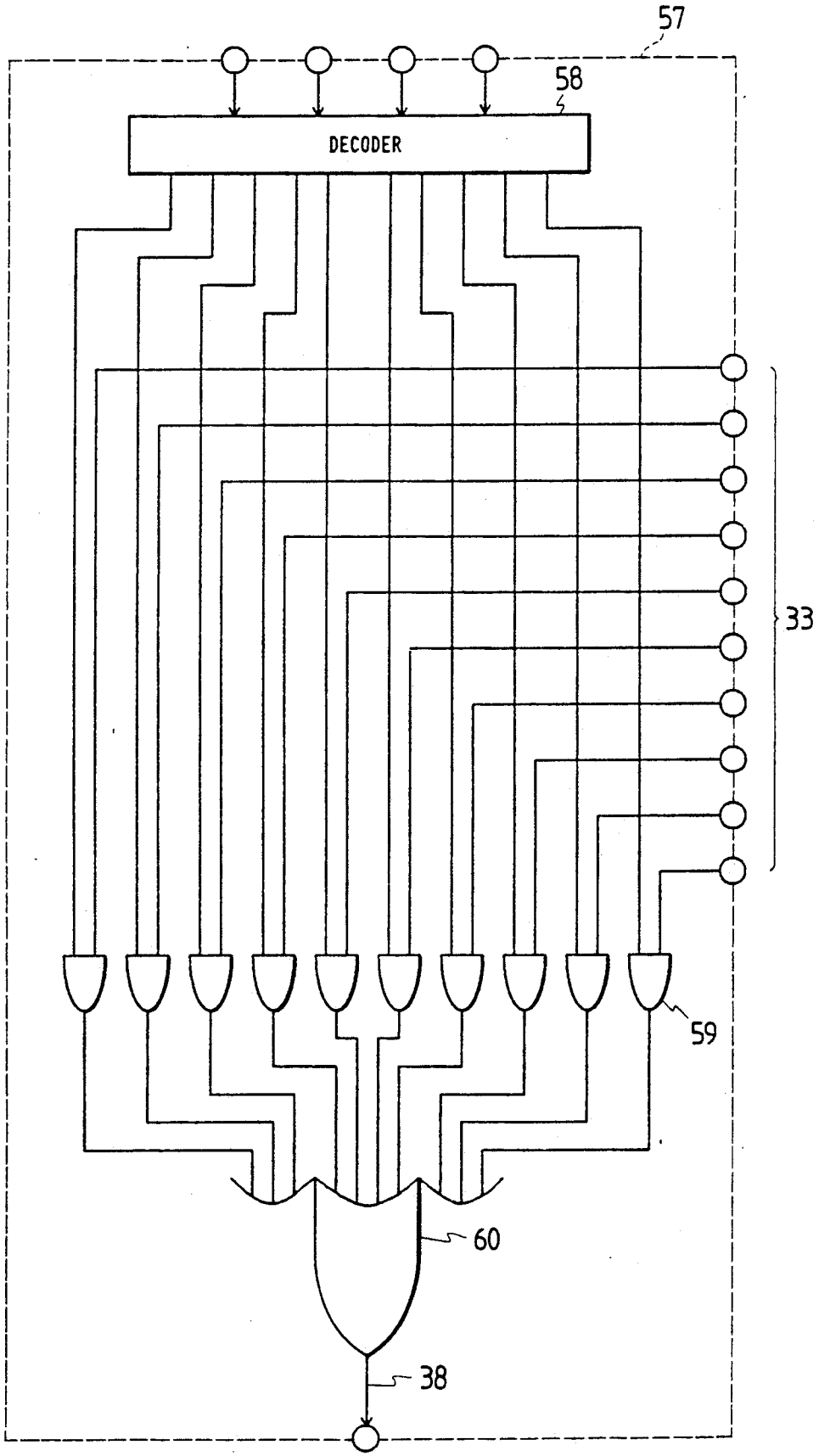
FIG. 12 is a detailed drawing of a gray scale controller in FIG. 11.

FIG. 12 is a drawing showing details of the multiple gray scale controller 57. In the figure, circuit blocks and signal lines having corresponding functions to those in FIG. 11 are denoted by corresponding reference numerals. Referring to FIG. 12, reference numeral 58 denotes a four-bit decoder, 59 denotes an AND circuit, and 60 denotes an OR circuit having 10 inputs. The decoder 58 decodes gray scale select information and outputs a decoded signal corresponding to the selected gray scale signal to the AND circuits 59. Thereupon, one of the 10 gray scale signals is selected by means of the ten AND circuits 58 and one OR circuit 60, and the selected signal is output to the selected gray scale signal line 38. In the described manner, the multiple gray scale controller 57 can select the information of the gray scale signal lines 33 at will. Therefore, it can select the gray scale signal corresponding to each of eight colors from the ten kinds of gray scale signals.

In short, in a display circuit arranged for eight-gray scale display, eight gray scales are selected out of ten gray scales according to characteristics of the LCD used. For example, when employing an LCD from one manufacturer, the best gray scale display can be achieved by using the gray scale signals Y0, Y3–Y9 shown in FIG. 10. Meanwhile, in the case of an LCD from another manufacturer, the best gray scale display can be achieved by using the gray scale signal Y0–Y6, Y9.

As described above, the present embodiment makes it possible to obtain the best gray scale display without the need for a change in the hardware but just by a change in the arrangement of the software according to the characteristics of the LCD used. Since, in particular, characteristics of LCDs change with the improvement in the quality of display, man-hours for development of hardware for display apparatuses using LCDs can be reduced substantially.

The present invention is not limited to the above described embodiment; that is, the selectable number of gray scales may be larger than ten. By increasing the degree of freedom in the gray scale select means, a wider variety of characteristics of the LCDs can be coped with. Then, the gray scale pattern of the gray scale signal shown in FIG. 10 as it is may be stored in a storage device (RAM or ROM) so that the gray scale signals are generated thereby. This system may be described below as a fourth embodiment.

Figure 13:
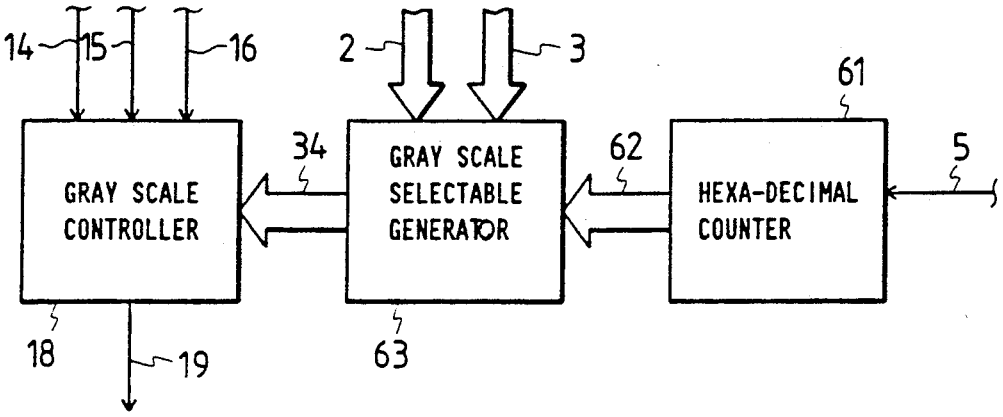
FIG. 13 is a block diagram showing a fourth embodiment of the present invention.

FIG. 13 is a block diagram showing a portion of a display circuit. In the figure, circuit blocks and signal lines having corresponding functions to those in FIG. 1 are denoted by corresponding reference numerals. Referring to FIG. 13, reference numeral 61 denotes a hexadecimal (mod-16) counter, 62 denotes a counter output signal line, and 63 denotes a gray scale selectable generator in the present embodiment. The gray scale selectable generator 63, by means of the address bus 2 and the data bus 3, sets up the gray scale pattern information in the internal RAM. The above gray scale pattern information is selected according to information on the counter output line 62 of the hexadecimal counter 61 for the FLM signal 5, and it is output to the selected gray scale signal line 34. Thus, the gray scale controller 18 is enabled to output the gray scale signal corresponding to each display color.

The gray scale selectable generator 63 as the central portion of the present embodiment will be described below in detail.

Figure 14:
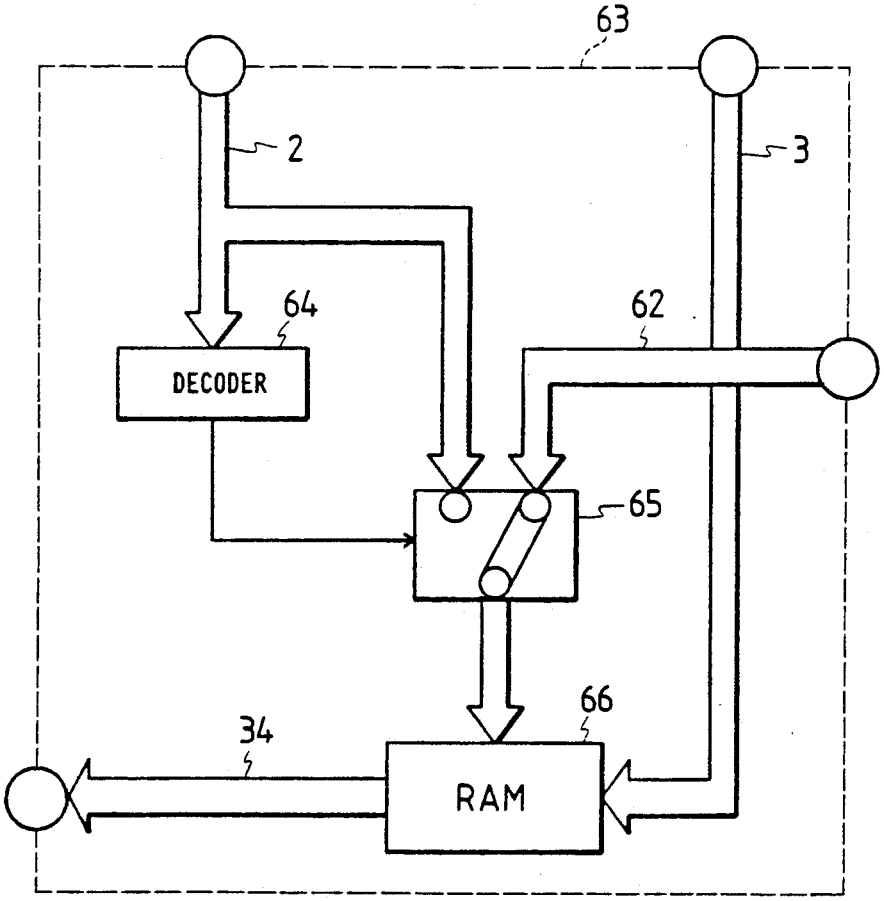
FIG. 14 is a detailed drawing of a gray scale selector in FIG. 13.

FIG. 14 is a drawing showing details of the gray scale selectable generator 63. In the figure, circuit blocks and signal lines having corresponding functions to those in FIG. 13 are denoted by corresponding reference numerals. Referring to FIG. 14, reference numeral 64 denotes a decoder, 65 denotes a selector, and 66 denotes a 16 words×8 bits RAM. Each bit of the data of the RAM 66 corresponds to each color. In the present example, it is arranged such that D7=white, so forth to D0=yellow, D5=purple, and D6=black. Each address of the RAM 66 corresponds to one frame, and the data at the address represents ON/OFF information of the display data for each color in the frame. Setting of the information in the RAM 66 is made by means of the address bus 2 and the data bus 3. The decoder 64 makes the decoded signal effective when the address on the address bus 2 indicates the address information in the RAM 66. Thereby, the selector 65 selects the address bus 2 so that the information on the data bus 3 is set up in the RAM 66. In contrast, when information is not set up in the RAM 66, the selector 65 selects the counter output line 62 so that information set in the RAM 66 is read out. Since, at this time, the address in the RAM 66 is designated by the output of the hexadecimal counter 61, the address is renewed for each frame. Hence, the established data at each of the addresses 0, 1, . . . , 15 is read out in succession from the RAM 66 for each frame. Since each bit of the established data is the ON/OFF information for displaying each color as described above, the same bits at 16 addresses constitute the gray scale pattern of 16 frame cycles.

In this way, the output information of the RAM 66 is supplied to the selected gray scale signal line 34 as eight gray scale signals corresponding to the display color. In the present case, 16 frames constitute the gray scale cycle and 17 kinds of gray scale signals can be generated. Since the data in the RAM 66 can be optionally altered, any desired gray scale can be assigned to each display color. Though the embodiment has been described above using a RAM, the same effects can be easily obtained using a ROM. Then, it is impossible to change the gray scale pattern by software, but the requirement can be met by exchanging the ROM for another ROM having different contents. Further, as is apparent from the above description, by increasing the number of addresses in the RAM, the number of gray scales to be selected from can be increased, and by expanding the width of the data, gray scales for a larger number of colors than eight can be easily obtained.

As understood from the foregoing description, use of storage devices in the present embodiment, though it increases the cost to a certain degree, makes it possible not only to freely select a gray scale from prepared gray scale signals but also to control the gray scale pattern of the gray scale signal at will. Therefore, such an affect is obtained that it can support LCDs of a wide variety of characteristics.

Figure 15:
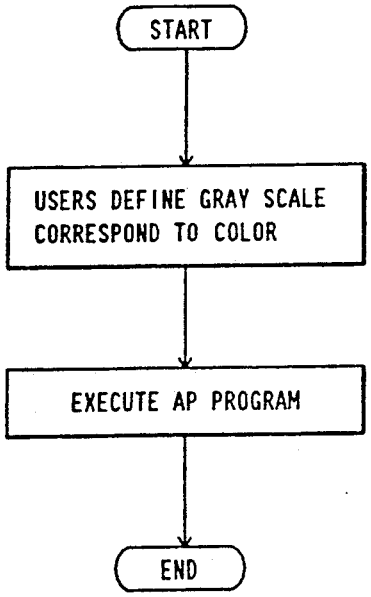
FIG. 15 and FIG. 16 are flow charts showing examples of use of the present invention.

Now, an embodiment of the method of using the present invention will be described. FIG. 15 is an example of the method of using the present invention. When a user executes an application software program (hereinafter to be briefly referred to as "AP soft") for color display to do a job, the correspondence between color and gray scale is established in advance. Namely, it is a characteristic of this embodiment that it provides the user with the means to establish information of such a correspondence that the user considers suitable according to the coloring in the AP soft to be executed.

Therefore, existing AP soft need no amendment and good color emulation of it can be attained. Because the number of AP soft is as great as hundreds or so in general, the man-hours that might be required for amending such AP soft for gray scale displaying may be huge, and in this sense, the present method brings about considerable effect.

Figure 16:
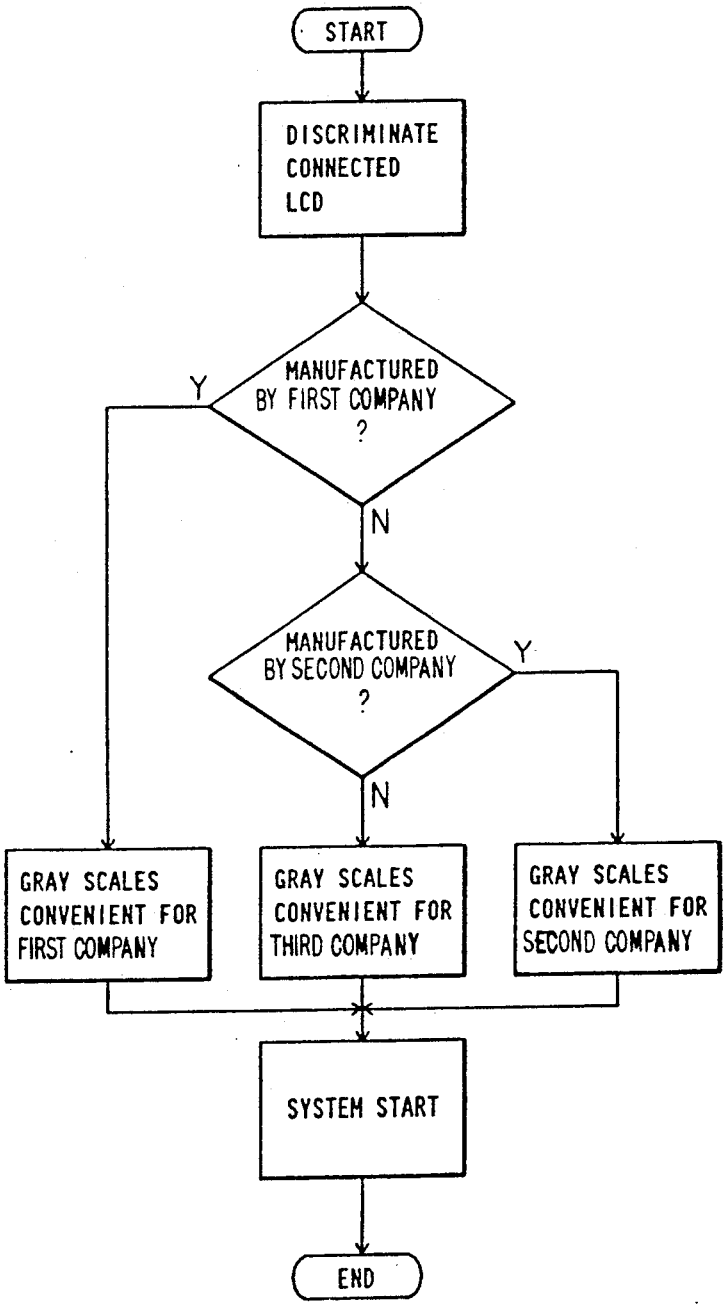

The above described example was a method for use concerned with correspondence between colors and gray scales. Now, a method for use concerned with correspondence between characteristics of LCDs and gray scales. FIG. 16 shows an example of use concerned with some LCDs and corresponding gray scales. Before starting such a system as a personal computer, the user determines the LCD that is connected and selects gray scale information adapted for the characteristic of the LCD. Thus, if it is an LCD from a first manufacturer, the gray scale information suitable for it is selected, and the color emulation is carried out using that information. In short, the point that neither hardware nor software of the system is affected by the characteristics of the LCD is a feature of this embodiment.

Therefore, even when LCDs are advanced further accompanied by changes in their characteristics, it is not necessary to develop another system accordingly, so that effective product development can be achieved.

According to the present invention, since the user can select the correspondence between the displayed colors and the gray scale information, the effect can be obtained, when executing application software intended for color displaying, that optimum color emulation with gray scale displaying can be achieved. Further, since the present invention can support a plurality of LCDs and the like having different characteristics concerning duty ratios for displaying and luminance, utility of the display apparatus to general purposes can be enhanced, and efficiency in the development of hardware can be improved. Besides, since the gray scale pattern of gray scale information can be set in a storage device, the gray scale information faithfully meeting characteristics of the aforesaid LCDs or the like can be generated so that a display apparatus of high versatility can be provided.

When a system with the present invention applied thereto is considered as a whole, since color displaying can be emulated with good gray scale displaying requiring no change in the application software, the man-hours that might be required for the change can be saved. Furthermore, since optimum gray scale information can be selected at a start of a system according to characteristics of the aforesaid LCDs or the like, it is possible to obtain a display apparatus of high versatility, as such a system that neither its hardware nor its software is affected by characteristics of display devices such as LCDs.

What is claimed is:

1. An apparatus for gray scale display comprising:

display memory means for storing display information, including color information for colors formed by combining a plurality of colors;

gray scale signal generating means for generating a plurality of gray scale signals for a predetermined color corresponding to one of the colors represented by the color information;

gray scale selecting means responsive to receipt of the plurality of gray scale signals for the predetermined color from said gray scale signal generating means for selecting one of the gray scale signals for the predetermined color;

means for controlling the gray scale corresponding to each of the plurality of colors to obtain a specific display contrast; and video signal generating means for generating a video signal corresponding with the gray scale signal selected by said selecting means.

2. The apparatus for gray scale display according to claim 1, wherein:

said gray scale signal generating means includes means for generating gray scale signals of a number larger than the number of colors represented by the color information; and said gray scale selecting means includes means for selecting any of the gray scale signals for each of the colors.

3. The apparatus for gray scale display according to claim 1, further comprising display means coupled to said video signal generating means for displaying the video display represented by the generated video signal.

4. A method for gray scale display comprising the steps of:

storing display information, including color information for colors formed by combining a plurality of colors;

generating a plurality of gray scale signals for a predetermined color corresponding to one of the colors represented by the color information;

selecting one of the plurality of gray scale signals for the predetermined color;

controlling the selected gray scale signal of the predetermined color to obtain a specific display contrast; and displaying the controlled gray scale signal.

5. The method for gray scale display according to claim 4, wherein:

the gray scale signal generating step includes generating gray scale signals of a number larger than the number of colors represented by the color information; and the gray scale signal selecting step includes selecting any of the gray scale signals for each of the colors.

* * * * *